United States Patent [19]

Hatabe et al.

[11] Patent Number: 4,702,588

[45] Date of Patent: Oct. 27, 1987

[54] APPARATUS FOR PRODUCING AN ELECTROPHOTOGRAPHIC PRINT

[75] Inventors: Yukio Hatabe; Shoji Komatsubara, both of Hikone, Japan

[73] Assignee: Dainippon Screen Mfg. Co., Ltd., Kyoto, Japan

[21] Appl. No.: 815,582

[22] Filed: Jan. 2, 1986

[30] Foreign Application Priority Data

Jan. 19, 1985 [JP] Japan ..... 60-7683

[51] Int. Cl.[4] ..... G03G 15/10

[52] U.S. Cl. ..... 355/10; 118/659; 354/317

[58] Field of Search ..... 355/3 R, 3 DD, 10; 354/317, 300, 324; 118/647, 659, 660

[56] References Cited

U.S. PATENT DOCUMENTS

| | | | |
|---|---|---|---|
| 1,928,235 | 9/1933 | Taylor | 354/317 X |
| 2,922,352 | 1/1960 | Tuttle et al. | 354/317 |
| 3,741,643 | 6/1973 | Smith et al. | 355/10 |
| 4,244,321 | 1/1981 | Plumadore | 355/10 X |
| 4,247,191 | 1/1981 | Grace et al. | 355/10 X |
| 4,271,559 | 6/1981 | Blumenthal | 15/308 |
| 4,358,195 | 11/1982 | Kuehnle et al. | 355/10 X |

FOREIGN PATENT DOCUMENTS 0007193 1/1980 European Pat. Off. .

*Primary Examiner*—Fred L. Braun

*Attorney, Agent, or Firm*—Brumbaugh, Graves, Donohue & Raymond

[57] ABSTRACT

An apparatus for producing an electrographic print on a photosensitive receptor placed on a holder so as to produce an electrostatic latent image on the receptor by projecting light thereon, the apparatus including a developing unit located below the receptor holder, the developing unit including a developing section, the developing unit or the receptor holder being movable in relation to the other, the developing section supplying a developer to the sensitive receptor so as to make the electrostatic latent image visible, and a mechanism for collecting the used developer from the sensitive receptor, the collecting mechanism including a pneumatic knife for blowing the used developer on the sensitive receptor to a place of collection, and an arrangement for receiving the used developer brought by the pneumatic knife, the receiving arrangement being provided on that surface of the receptor holder which is outside the sensitive receptor, the receiving arrangement being provided in a direction perpendicularly to the direction in which the receptor holder or the developing unit is moved.

15 Claims, 4 Drawing Figures

APPARATUS FOR PRODUCING AN ELECTROPHOTOGRAPHIC PRINT

BACKGROUND OF THE INVENTION

1. Field of the Invention

The present invention relates generally to an apparatus for producing an electrophotographic print on a photosensitive material, and more particularly, a wet-type electrophotographic copying machine including a device for removing the used developer remaining on the photosensitive material.

2. Description of the Prior Art

In a wet-type electrophotographic copying machine, hereinafter referred to merely as the copying machine, it is essential to remove the used developer remaining on the photosensitive material, hereinafter referred to as a sensitive receptor or merely a receptor. The common practice is to use a pneumatic knife whereby the remainder of developer on the sensitive receptor is removed.

However, the used developer blown by the pneumatic knife is likely to deposit at one spot on the receptor holder, and as the deposit becomes excessive, it tends to fall in droplets, and eventually returns to the reservoir. The problem is that the used developer has a reduced toner concentration. If such a diluted developer enters the reservoir, the concentration of toner in the developer therein is likely to decrease, thereby resulting in the deteriorated developing ability. This requires special care to be constantly taken so as to keep the toner concentration adequate. When color toners are used, it may happen that one color gets mixed with another, thereby spoiling the finished color tone. This will be fatal to the color copying.

OBJECTS AND SUMMARY OF THE INVENTION

The present invention is directed to solve the problems pointed out above, and has for its object to provide a copying machine including a device for removing the used developer remaining on the sensitive receptor without returning it to the reservoir, thereby keeping the developer in the reservoir constantly fresh.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to the present invention, there is provided an apparatus for producing an electrographic print on a photosensitive receptor placed on a holder so as to produce an electrostatic latent image on the receptor by projecting light thereon, the apparatus comprising a developing unit located below the receptor holder, the developing unit including a developing section, the developing unit or the receptor holder being movable in relation to the other, the developing section supplying a developer to the sensitive receptor so as to make the electrostatic latent image visible; and means for collecting the used developer from the sensitive receptor, the collecting means including a pneumatic knife for blowing the used developer on the sensitive receptor to a place of collection, and means for receiving the used developer brought by the pneumatic knife, the receiving means being provided on that surface of the receptor holder which is outside the sensitive receptor, the receiving means being provided in a direction perpendicularly to the direction in which the receptor holder or the developing unit is moved.

As the photosensitive receptor the following may be used in conjunction with the present invention: a backing of relatively electrically conductive material sheet such as paper or plastic film coated with an electroconductive materials, or of metal plate having a coating of electrophotoconductive material layer such as titanium dioxide, zinc oxide, and the like, dispersed in a resinous binder on one surface thereof to provide the electrophotoconductive surface. It is especially advantageous to use a photosensitive receptor containing titanium dioxide, this results in a multicolor print image having high contrast with good continuous gradation of the image such as that pictorial tone resembling the appearance obtainable in silver halide photography.

DETAILED DESCRIPTION OF THE PREFERRED EMBODIMENT

The illustrated example is a color proof electrophotographic copying machine. Of course the application of the present invention is not limited to it, but the color proof copying machine has been taken up for illustration purpose only. The machine is used, prior to the regular printing, to see whether the film obtained through color separation of the original is appropriate or not. The machine functions as a proofreader.

Figure 2:
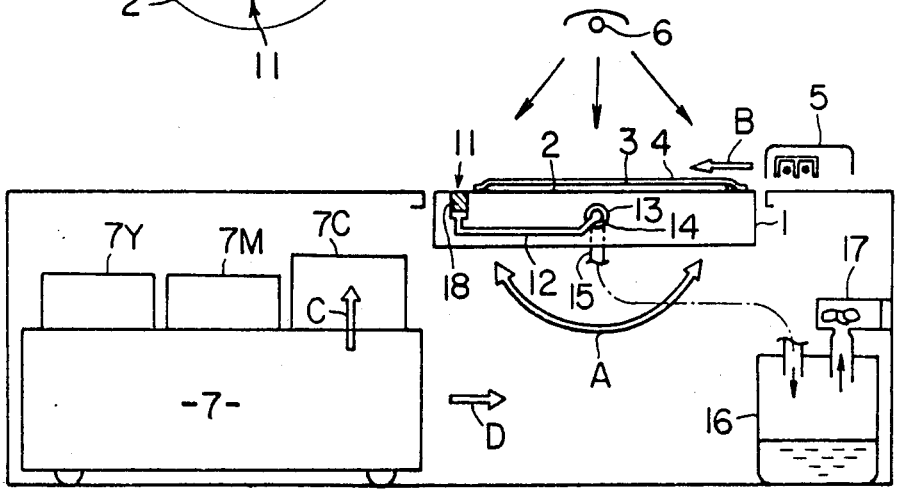
FIG. 2 is a cross-sectional side view of the copying machine of FIG. 1.
Figure 4:
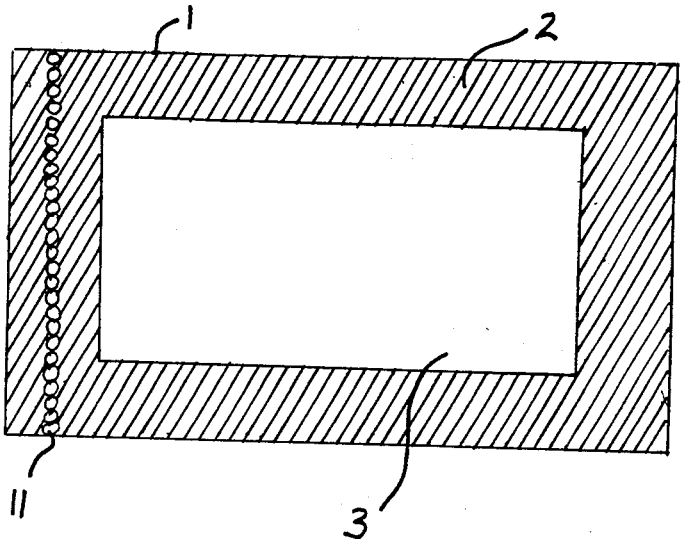
FIG. 4 is a bottom view of the photosensitive receptor holder of the copy machine in FIG. 1.

The machine is operated as follows:

In FIG. 2 a holder 1 for holding a photosensitive receptor 3 rotatively supported on a frame (not shown) is rotated in the direction of arrow (A), so as to enable its holder surface 2 to turn upward on which the photosensitive receptor 3 is placed. The position of the receptor 3 is decided by the use of pins (not shown), and secured thereon under suction.

Then, an electrostatic charger 5 is caused to run in the direction of arrow (B), during which electrostatic charge is given on the entire surface of the photosensitive receptor 3. Subsequently, a color separation film (e.g. for cyan) 4 is overlaid on the charged receptor 3, whose position is also decided by means of pins and secured under suction. Finally a light 6 is lit so that the image on the film 4 is projected onto the receptor 3, thereby producing the electrostatic latent image thereon.

Figure 1:
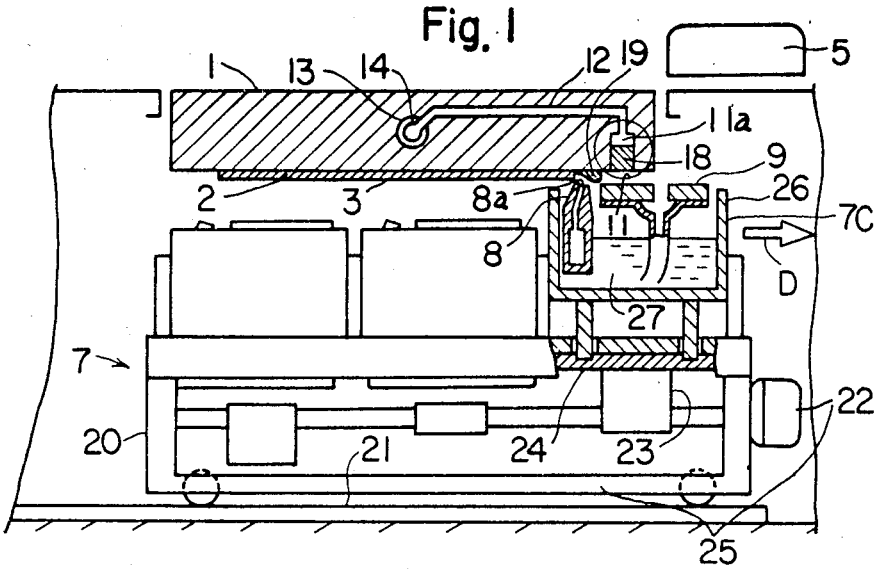
FIG. 1 is a cross-section through a wet-type electrophotographic copying machine including a device embodying the present invention.

The color separation film 4 is removed from the receptor 3, which is still secured under suction. At this stage the receptor holder 1 is moved in the direction of arrow (A) until the receptor 3 looks downward as shown in FIG. 1. The developing section 7*c* in a wet-type developing unit 7 which corresponds to the color separation film 4 is raised in the direction of arrow (C), and simultaneously, the developing unit 7 is moved in the direction of arrow (D). In this way the latent image on the receptor 3 is subjected to color development, thereby producing visible color image.

In this way exposure and development are repeated for the whole surface of one receptor 3 until the image on the color original is completely reproduced as a proof.

The mechanical structure of the machine will be described in greater detail:

There is provided a special unit for removing a remainder of a liquid developer at an appropriate place on the photosensitive receptor holder surface 2. In the illustrated example the unit includes a suction groove 11 whose depth is perpendicular to the direction of arrow (D) in which the developing unit 7 is moved, a suction duct 14 connected to the groove 11 through a pipe 12, the duct 14 being producted through a rotary shaft 13, and a suction means 17 connected to the suction duct 14, an inlet pipe 15 and a drain 16. A remainder 19 of the liquid developer is sucked from the surface of the receptor 3. The sucked remainder 19 is led to the drain 16 through the groove 11, pipe 12 and duct 14.

The groove 11 is provided with an absorbent material 18, such as felt or sponge with a space 11*a* at the bottom of the groove 11. The space 11*a* is intended to enable the sucking force from the pipe 12 to diffuse extensively against the absorbent material 18. If no space 11*a* is present, the sucking force is likely to concentrate on the part where the pipe 12 is jointed to the groove 18.

The function of the absorbent material 18 will be described in detail:

If no absorbent material 18 is used, some of the liquid remainder 19 is likely to stay in droplets on the inside walls of the groove, thereby clogging the groove 11 partly or wholly. Once such clogging has occurred, the sucking force will act exclusively on the part of the part of the groove 11 which is free from the staying droplets, thereby reducing the efficiency of suction. Otherwise the suction would lose its continuity and become intermittent. The absorbent material 18 packed in the groove 11 is effectively resistant not only to the flow of air but also to the liquid remainder 19 being sucked, thereby enabling the sucking force to diffuse evenly in the groove 11 regardless of whether the absorbent material is impregnated with the liquid remainder 19.

The developing unit 7 includes developing sections 7C, 7M and 7Y for cyan, magenta and yellow, respectively. In these sections the respective color electrostatic latent images are developed. Where required, another section (not shown) is provided for black. On the sensitive receptor 3 a particular latent image for one color is produced, which is developed with the particular color toner. This procedure is repeated several times until all the color images are developed.

Each section 7C, 7M and 7Y is moved reciprocally in the directions of arrow (D). This is achieved by mounting these sections on a carrier 20, which is movable in the direction of arrow (D). On the carrier 20 each section is also movable in the direction of arrow (C) independently of the others. More specifically the carrier 20 is moved by means of a driving mechanism including a motor, chains and the like (not shown) along a guide rail 21 to and fro in the direction of arrow (D). When the desired section e.g. the section 7C comes immediately before the receptor holder 1, a lifting unit 25 including a motor 22, a crank 23, a lifter table 24 and the like is operated to raise the section 7C until it comes near the sensitive receptor 3. In this way a developer 27 in a reservoir 26 is supplied to the surface 2 of the receptor 3 by means of a pump (not shown). The section 7C continues to move until it covers the whole surface 2 of the receptor 3. When it has passed the receptor 3, the supply of developer is automatically stopped.

Each section 7C, 7M and 7Y is equipped with a pneumatic knife 8 including an air outlet 8*a*, the pneumatic knife being located adjacent to electrodes 9. The pneumatic knife 8 is to blow the liquid remainder 19 on the receptor 3 in the direction of arrow (D) in which the section 7C, 7M or 7Y is moved.

In this way the liquid remainder 19 is blown toward the groove 11, through which it is sucked finally into the drain 16.

In the illustrated embodiment the groove 11 is engraved perpendicularly to the direction of (D) in which the developing section is moved, wherein the groove is provided with the absorbent material 18, having the small space 11*a* left at the bottom. However, the invention is not limited to this structure.

For example, the absorbent material can be fully packed in the groove without the space 11*a*, or alternatively it is possible to use no absorbent material at all although the efficiency is reduced.

Figure 3:
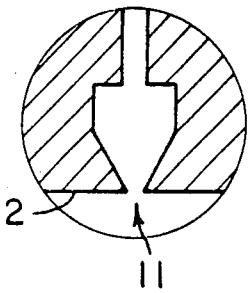
FIG. 3 is a schematic view showing a modified version of the device embodying the present invention.

The cross-section of the groove 11 can be shaped as shown in FIG. 3, that is, the opening is constricted whereas the passage is widened toward the depth. Instead of the groove many pores can be arranged crosswisely of the width of the holder 2, wherein they are preferably spaced from one to another at minimum intervals.

For the absorbent material 18 felt, sponge, cloth or the like can be selectively used. However, it is important for the material not to extrude from the surface 2 of the receptor holder 1. To this end it is preferred to make a recess on the surface of the holder, so as to have the absorbent material packed therein.

When the absorbent material is saturated with the used developer, it is required to dry it; for example, by ejecting hot air onto the wet absorbent material. Another possible way is to suck the absorbed developer by means of a suitable sucking device provided outside the recepter holder 1, wherein a sucking pat is intermittently applied to the saturated material. Alternatively, the absorbent material can be provided in such a manner as to cover the suction opening provided on the surface of the holder 1, and lead the developer out of the holder surface 2 through the holder body.

When a negligible amount of developer remains, the groove may be provided with no absorbent material. In this case there will be a danger of the developer dropping through the groove, but as it stays on the inside walls of the groove, it rarely happens that it falls in droplets.

For driving the developing unit 7 in the direction of arrow (D) a pulse motor can be employed, whereby the top or rear end of the receptor 3 held on the holder 1 is detected as previously set, thereby effecting the automatic supply of developer.

The foregoing description has been given with respect to the application of the invention to a color proof electrophotographic copying machine, but the invention is not limited to it. For example, it can be applied to a monochromatic electrophotographic copying machine including a single developing section.

As evident from the foregoing description, the present invention has the following advantages:

(1) The used developer remaining on the sensitive receptor is effectively removed without returning to the reservoir, thereby keeping the surface of the sensitive receptor free from the used developer.

(2) The removal of the used developer ensures that the developer stored in the reservoir is protected against dilution and contamination, thereby securing a prolonged life of the developer, and an effective concentration of the toner content.

(3) In multicolor copying machines the developer stored in the reservoir is protected against possible contamination with other color, thereby keeping the developer stored in the reservoir constantly pure. On the sensitive receptor the used developers of different colors are prevented from getting mixed with each other, thereby securing a clear reproduction of color image.

While the invention has been illustrated and described as embodied in a wet-type electrophotographic copying machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. An apparatus for producing an electrographic print on a photosensitive receptor placed on a holder so as to produce an electrostatic latent image on the receptor by projecting light thereon, the apparatus comprising: a developing unit located below the receptor holder, the developing unit including a developing section, at least one of the developing unit and the receptor holder being movable in relation to the other, the developing section supplying a developer to the photosensitive receptor so as to make the electrostatic latent image visible; and means for collecting used developer from the photosensitive receptor, the collecting means including a pneumatic knife for blowing the used developer on the photosensitive receptor to a place of collection, and means for receiving the used developer blown by the pneumatic knife, the receiving means being provided as a continuous recess on an area of a surface of the receptor holder which is outside the photosensitive receptor, the receiving means being provided in a direction crossing to the direction in which the receptor holder or the developing unit is moved, the receiving means further including means, associated with said continuous recess, for sucking the used developer received therein.

2. An apparatus as defined in claim 1, wherein the receiving means is provided as a sucking opening on the receptor holder.

3. An apparatus as defined in claim 2, wherein the sucking opening is a groove produced in a direction perpendicularly to the direction in which the receptor holder or the developing unit is moved.

4. An apparatus as defined in claim 3, wherein the groove has an absorbent material packed therein.

5. An apparatus as defined in claim 4, wherein the absorbent material is packed in the groove so that the opening of the groove is closed.

6. An apparatus as defined in claim 5, wherein the absorbent material is packed so as to provide a space between the material and the bottom of the groove.

7. An apparatus as defined in claim 4, wherein the absorbent material is packed in the groove so that the whole space of the groove is closed.

8. An apparatus as defined in claim 3, wherein the groove has an opening constricted on the surface of the receptor holder, and a passage widened toward the depth.

9. An apparatus as defined in claim 2, wherein the sucking opening is constituted by a number of pores produced in a direction perpendicularly to the direction in which the receptor holder or the developing unit is moved.

10. An apparatus as defined in claim 1, wherein the receiving means comprises an absorbent material fixed on the receptor holder.

11. An apparatus as defined in claim 10, wherein at least some of the absorbent material is packed in a recess produced on the receptor holder.

12. An apparatus as defined in claim 10, wherein the absorbent material covers a sucking opening of the collecting means extending through the receptor holder.

13. An apparatus as defined in claim 1, wherein the receiving means comprises a groove-shaped recess produced in a direction perpendicularly to the direction in which the receptor holder or the developing unit is moved.

14. An apparatus as defined in claim 1, wherein the developing unit includes a number of developing sections corresponding to the number of colors to be used.

15. An apparatus as claimed in claim 1, wherein the developing unit includes a developing section for monochrome print.

* * * * *

UNITED STATES PATENT AND TRADEMARK OFFICE

CERTIFICATE OF CORRECTION

PATENT NO. : 4,702,588

DATED : October 27, 1987

INVENTOR(S) : Yukio Hatabe et al.

It is certified that error appears in the above-identified patent and that said Letters Patent is hereby corrected as shown below:

First page, Item 73, add thereto --and Ishihara Sangyo Kaisha Ltd., Osakafu, Japan--;
Column 2, line 9, "materials" should read --material--;
Column 3, line 16, "producted" should read --produced--;
Column 4, line 42, "recepter" should read --receptor--.

Signed and Sealed this

Nineteenth Day of July, 1988

*Attest:*

DONALD J. QUIGG

*Attesting Officer*

*Commissioner of Patents and Trademarks*